US007564332B2

(12) United States Patent
Telep

(10) Patent No.: US 7,564,332 B2
(45) Date of Patent: Jul. 21, 2009

(54) VARIABLE FORCE SOLENOID

(75) Inventor: Robert J. Telep, Livonia, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/712,345

(22) Filed: Feb. 28, 2007

(65) Prior Publication Data

US 2007/0152790 A1 Jul. 5, 2007

Related U.S. Application Data

(63) Continuation of application No. 10/863,586, filed on Jun. 8, 2004, now Pat. No. 7,209,020.

(60) Provisional application No. 60/477,309, filed on Jun. 9, 2003.

(51) Int. Cl.
*H01F 3/00* (2006.01)
*H01F 7/08* (2006.01)

(52) U.S. Cl. ..... 335/255; 335/261; 335/270; 335/279; 335/281

(58) Field of Classification Search ..... 335/255–282
See application file for complete search history.

(56) References Cited

U.S. PATENT DOCUMENTS 3,900,822 A 8/1975 Hardwick et al.
4,097,833 A * 6/1978 Myers ..... 335/261
4,282,501 A * 8/1981 Myers ..... 335/258
4,553,121 A 11/1985 Logie
5,413,082 A 5/1995 Cook et al.
5,551,406 A 9/1996 Everingham et al.
5,779,220 A 7/1998 Nehl et al.
5,947,092 A 9/1999 Hussey et al.
6,102,364 A 8/2000 Busato
6,247,456 B1 6/2001 Everingham et al.
6,310,754 B1 10/2001 Busato
6,615,780 B1 * 9/2003 Lin et al. ..... 123/90.17
7,078,833 B2 * 7/2006 Xu ..... 310/14
2002/0060620 A1 5/2002 Bircann et al.
2002/0104977 A1 8/2002 Bircann et al.

OTHER PUBLICATIONS

Electromagnetic Devices by Herbert C. Roters, First Edition, 1941.

* cited by examiner

*Primary Examiner*—Ramon M Barrera
(74) *Attorney, Agent, or Firm*—Warn Partners, P.C.

(57) ABSTRACT

A variable force solenoid is described, wherein the solenoid has a relatively long stroke and a relatively low profile. The solenoid includes an armature with at least one tapered surface and a pole piece with at least one tapered surface. The armature and the pole piece may each be provided with multiple tapers on more than one surface thereof.

15 Claims, 10 Drawing Sheets

VARIABLE FORCE SOLENOID

CROSS-REFERENCE TO RELATED APPLICATIONS

This application is a continuation of U.S. patent application Ser. No. 10/863,586 filed on Jun. 8, 2004. This application claims the benefit of U.S. Provisional Application No. 60/477,309, filed Jun. 9, 2003. The disclosures of the above applications are incorporated herein by reference.

FIELD OF THE INVENTION

The present invention relates generally to variable force solenoids and more particularly to variable force solenoids that include relatively long stroke and relatively low profile characteristics.

BACKGROUND OF THE INVENTION

Electric solenoids have been used to provide a number of functions in automotive applications including, but not limited to idle speed control, exhaust gas recirculation valves, fuel vapor purge valves, and the like. Pneumatic actuators were used prior to electrically controlled solenoids. These solenoids were typically characterized as having either a relatively high force over a relatively short operating stroke, or having a relatively low force over a relatively long operating stroke.

The availability of space in conventional engine compartments has made it necessary to reduce the size of solenoids while maintaining their high force and stroke characteristics. One such application, i.e., that requires reduced packaging, is the solenoid actuator for a variable cam/valve timing mechanism that is used to control the opening and closing of the engine's valves.

In this application, the solenoid is required to control the mechanism over a predefined stroke. At the proximate center of the stroke, the mechanism will not change the cam/valve timing. As the solenoid moves from the proximate center of stroke to one end of the stroke, the mechanism will advance the cam/valve timing. As the solenoid moves from the proximate center of stroke to the opposite end of the stroke, the mechanism will retard the cam/valve timing. After changing the cam/valve timing, the solenoid is returned to the proximate center of stroke until a change to the cam/valve timing is required.

Controlling the cam/valve timing may provide benefits such as but not limited to higher engine power output, lower vehicle tailpipe emissions, higher fuel economy, and the like. However, conventional variable force solenoids have not been completely satisfactory with respect to their stroke and profile characteristics.

The basic construction of a traditional solenoid 10 with a flat-faced armature 12 is shown in FIG. 1, in accordance with the prior art. The other main components of the solenoid include the pole piece 14, coil 16, flux tube 18, and an area defining an air gap 20. The air gap 20 is generally defined as a variable space between the facing surfaces of the armature 12 and the pole piece 14.

With respect to operation, current is first applied to the coil 16 to provide a magnetizing force. The magnetic field created by this magnetizing force then induces magnetic flux throughout the magnetic circuit and across the air gap 20 between the armature 12 and the pole piece 14. Axial force is generated at the air gap 20 due to the attraction of the armature 12 to the pole piece 14. Movement of the armature 14 to close the air gap 20 can do useful work. The force is given by the following formula: $F=KA[(NI)^2/(AG)^2]$; wherein K=a constant; A=the armature area; N=the number of turns of the coil; I=the current; and AG=the air gap between the armature and pole piece.

Two problems generally arise if this type of solenoid is used. First, it is desired for the force to be proportional to the current, but is instead proportional to the current squared. Second, the force should be independent of armature position, but instead is proportional to $1/AG^2$.

Therefore, there exists a need for new and improved variable force solenoids, wherein the solenoids include features such as but not limited to relatively long stroke and low profile characteristics.

SUMMARY OF THE INVENTION

In accordance with the general teachings of the present invention, new and improved variable force solenoids are provided. More specifically, the solenoids of the present invention preferably provide relatively long stroke and relatively low profile. Additionally, the solenoids of the present invention preferably include armatures with at least one tapered surface and pole pieces with at least one tapered surface. Further, the armatures and the pole pieces of the present invention can preferably be provided with tapers on more than one surface thereof.

By way of a non-limiting example, the solenoid preferably includes a magnetic circuit consisting of: (1) a first magnetic component (e.g., an armature) with at least one tapered surface; and (2) a second magnetic component (e.g., a pole piece) with at least one tapered surface. The armature and pole piece can each have tapers on more than one surface thereof. Further, the armature and/or pole piece can have multiple tapers (e.g., compound angles) formed on one or more surfaces thereof. Additionally, the armature can be open at either end thereof and preferably includes a partition member along its axis located within the armature.

A third magnetic component (e.g., a flux tube) is preferably provided including a portion that is preferably adjacent to the external diameter surface, internal diameter surface, and end surface of the armature. The flux tube preferably includes a portion that is adjacent to the partition within the bore of the armature.

As noted, the solenoid of the present invention preferably includes a long stroke, relative to its length, combined with a high and relatively linear force vs. its stroke. Without being bound to a particular theory of the operation of the present invention, the long stroke combined with a high and relatively linear force vs. its stroke is achieved by the control of the cross-sectional area and the angles of the tapered portions of the armature and/or pole piece to provide an advantageous magnetic force vector that maximizes axial force while simultaneously providing increased axial/radial force ratios for low mechanical friction.

Additional preferred features of the solenoid of the present invention include, without limitation, that: (1) the support for the stem is at least partially located within the inner diameter of the armature; (2) the solenoid has at least a portion that is overmolded with a plastic material; (3) the solenoid has an integrated bracket for attachment; (4) the integral bracket is part of one of the solenoid components; (5) the solenoid has an integrated bracket for attachment that is not attached to the solenoid; (6) the bracket is supported in the solenoid assembly by overmolded plastic; (7) and/or the solenoid has a least one non-magnetic bushing that will both guide the stem and prevent the armature from magnetically "latching" to another magnetic component.

In accordance with a first embodiment of the present invention, a solenoid is provided, comprising: (1) a first magnetic member having an outer diameter, wherein the outer diameter includes at least one tapered surface formed thereon; and (2) a second magnetic member having an inner diameter, wherein the inner diameter includes at least one tapered surface formed thereon, wherein the first magnetic member is operable to be at least partially coaxially disposed within the second magnetic member.

In accordance with a second embodiment of the present invention, a solenoid is provided, comprising: (1) a first magnetic member having an outer diameter, wherein the outer diameter includes at least two tapered surfaces formed thereon; and (2) a second magnetic member having an inner diameter, wherein the inner diameter includes at least one tapered surface formed thereon, wherein the first magnetic member is operable to be at least partially coaxially disposed within the second magnetic member.

In accordance with a third embodiment of the present invention, a solenoid is provided, comprising: (1) a first magnetic member having an inner diameter, wherein the inner diameter includes at least one tapered surface formed thereon; and (2) a second magnetic member having an outer diameter, wherein the outer diameter includes at least one tapered surface formed thereon, wherein the first magnetic member is operable to be at least partially coaxially disposed within the second magnetic member.

In accordance with a fourth embodiment of the present invention, a solenoid is provided, comprising: (1) a first magnetic member having an inner and an outer diameter, wherein the inner and outer diameters include at least one tapered surface formed thereon; and (2) a second magnetic member having an inner and an outer diameter, wherein the inner and outer diameters include at least one tapered surface formed thereon, wherein the first magnetic member is operable to be at least partially coaxially disposed within the second magnetic member.

In accordance with a fifth embodiment of the present invention, a solenoid, comprising: (1) a first magnetic member having an inner and an outer diameter, wherein the inner and diameter includes at least one tapered surface formed thereon and the outer diameter includes at least two tapered surfaces formed thereon; and (2) a second magnetic member having an inner and an outer diameter, wherein the inner and outer diameters include at least one tapered surface formed thereon, wherein the first magnetic member is operable to be at least partially coaxially disposed within the second magnetic member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE PREFERRED EMBODIMENTS

The following description of the preferred embodiment(s) is merely exemplary in nature and is in no way intended to limit the invention, its application, or uses.

In accordance with the general teachings of the present invention, a solenoid design is provided that will provide relatively high force over a relatively long stroke. Without being bound to a particular theory of the operation of the present invention, the present invention will achieve this force and stroke with a solenoid length that is relatively small compared to its stroke. Additional features of the present invention include, without limitation, a design for supporting the stem of the solenoid over the entire stroke and the minimization of the radial forces and the resulting bearing friction.

Figure 1:
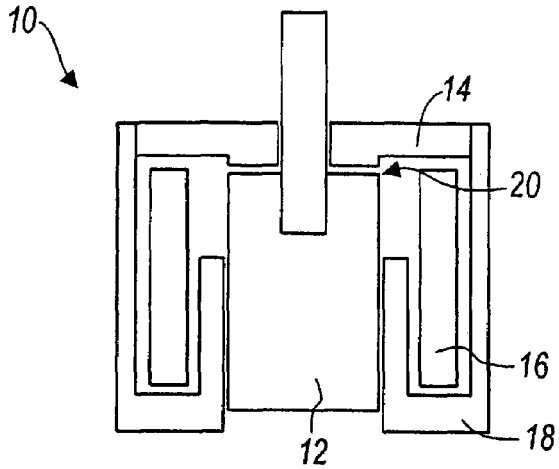
FIG. 1 (PRIOR ART)
FIG. 1 illustrates a sectional view of a conventional solenoid with a flat-faced armature, in accordance with the prior art.
Figure 2:
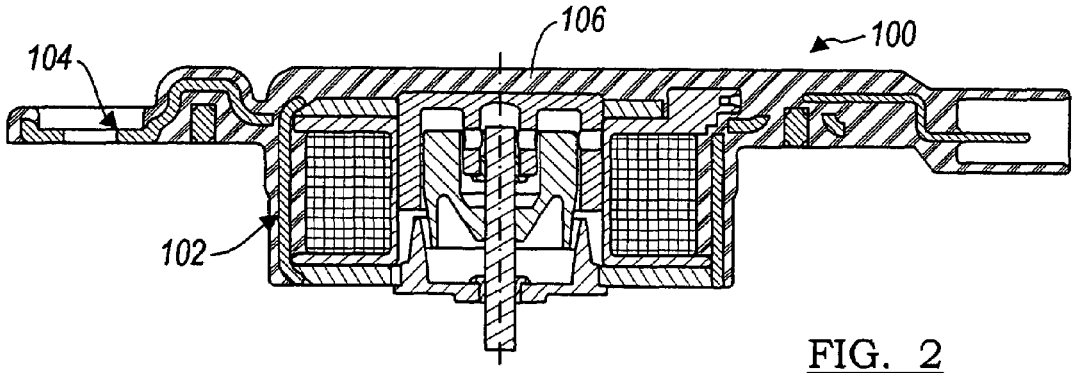
FIG. 2 illustrates a sectional view of a solenoid assembly, in accordance with the general teachings of the present invention.

Referring generally to the Figures, and more specifically to FIG. 2, the solenoid 100, in accordance with the general teachings of the present invention, preferably consists primarily of a solenoid subassembly 102, a bracket member 104, and a plastic overmold member 106. The plastic overmold member 106 preferably provides the structural requirements to fasten the bracket member 104 to the solenoid subassembly 102. The bracket member 104 preferably provides a suitable methodology for attaching the solenoid 100 in a fixed relationship to a variable cam/valve timing mechanism (not shown). It should be appreciated that the solenoid subassembly 102 is comprised of at least one, more preferably at least two, and still more preferably several magnetic components, such as but not limited to an armature, flux tube, pole piece, and the like.

Figure 3:
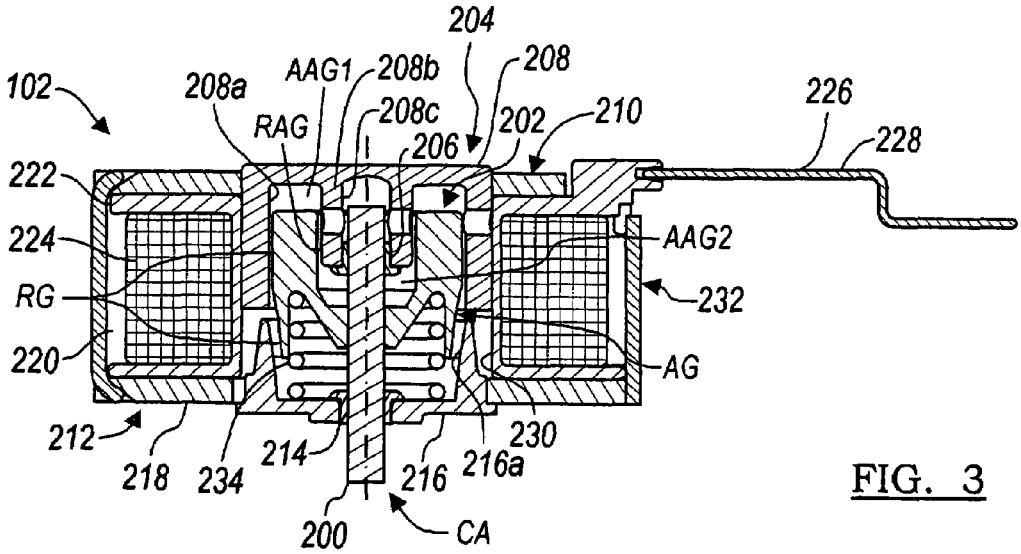
FIG. 3 illustrates a sectional view of a solenoid subassembly, in accordance with one embodiment of the present invention.

Referring specifically to FIG. 3, the solenoid subassembly 102 preferably includes a stem member 200 located along a central axis CA of the solenoid subassembly 102. An armature member 202 is preferably fastened to the stem member 200. A flux tube assembly 204, preferably including a bushing member 206, flux tube member 208, and washer member 210, is preferably located at one end of the solenoid subassembly 102. A pole piece assembly 212, preferably including a bushing member 214, pole piece member 216, and washer member 218, is preferably located at the other end of the solenoid subassembly 102. A coil assembly 220, preferably including a bobbin member 222, wire member 224, and terminals 226 and 228 is preferably located along central axis CA between the flux tube and pole piece assemblies, 204 and 212, respectively. A portion of the flux tube assembly 204 and pole piece assembly 212 preferably engage the inside diameter 230 of the coil assembly 220. A case 232 preferably holds the flux tube and pole piece assemblies, 204 and 212, respectively, in a fixed relationship and establishes a flux return path. The coil assembly 220, flux tube assembly 204, pole piece assembly 212 and/or case 232 are preferably located coaxial to the stem member 200, establishing an area defining an air gap AG.

Figure 4:
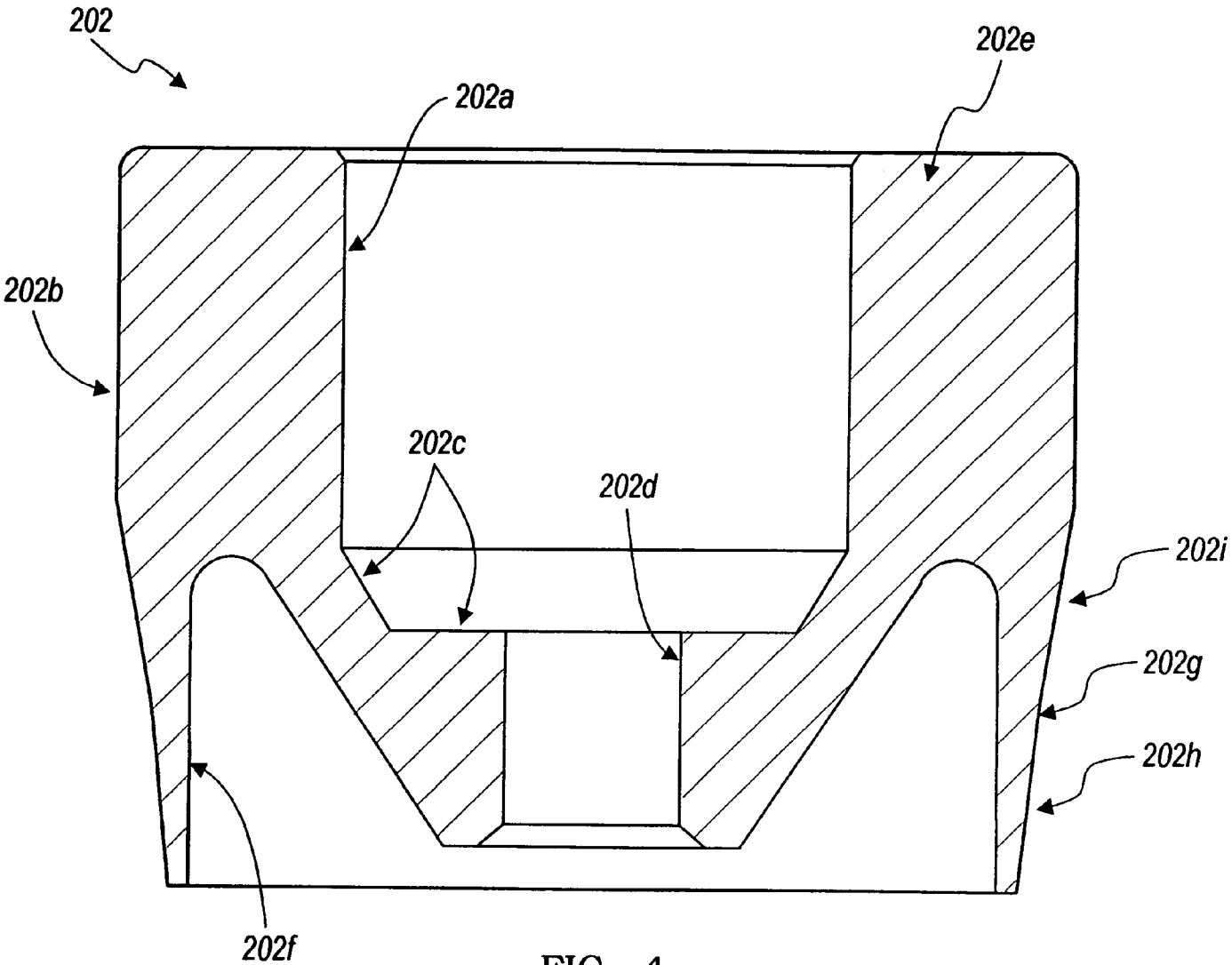
FIG. 4 illustrates a sectional view of an armature member of the solenoid subassembly depicted in FIG. 3, in accordance with one embodiment of the present invention.
Figure 5:
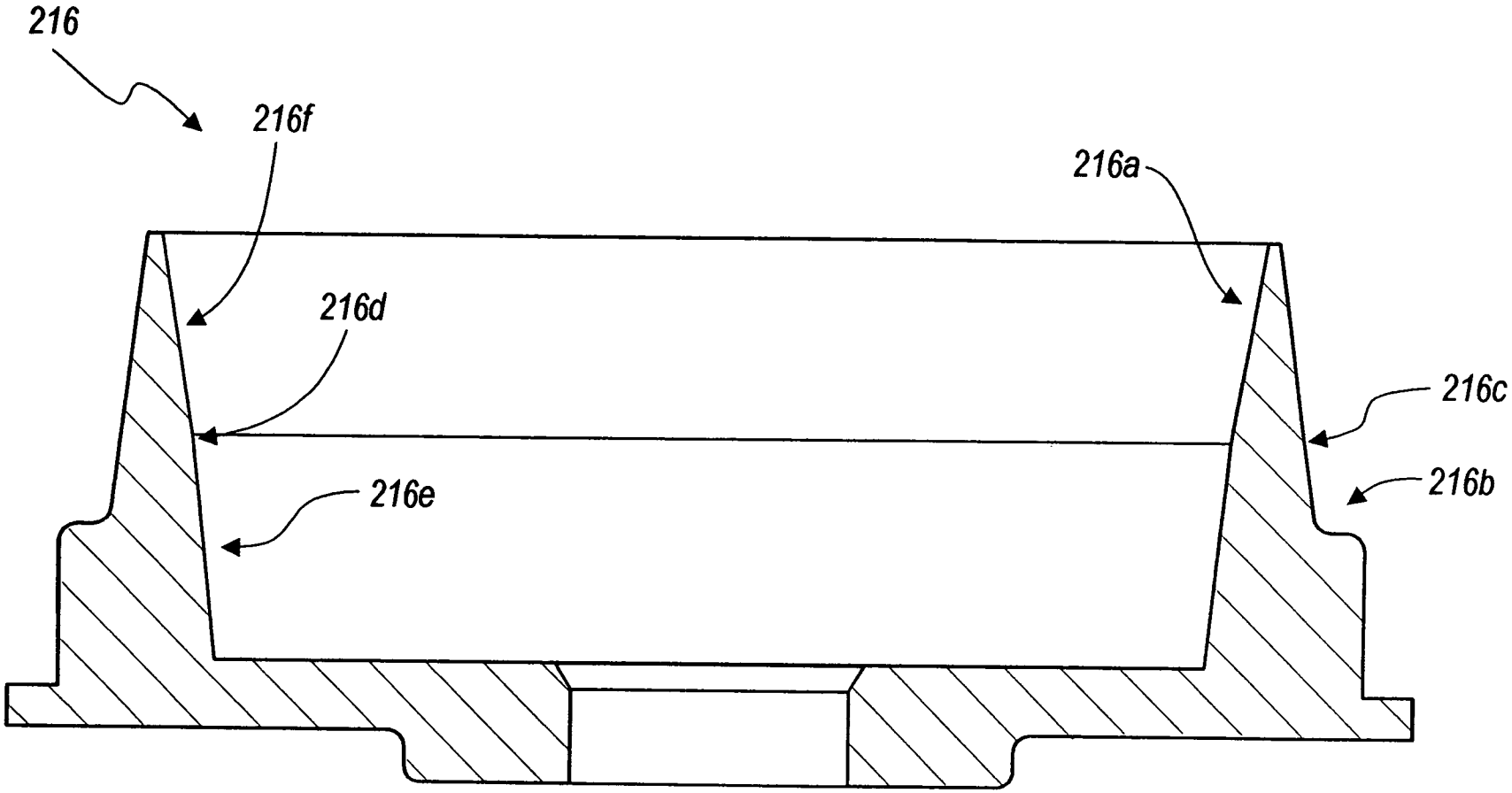
FIG. 5 illustrates a sectional view of a pole piece member of the solenoid subassembly depicted in FIG. 3, in accordance with one embodiment of the present invention.

Referring specifically to FIGS. 3-5, the armature member 202 preferably includes an inner diameter 202*a* and an outer diameter 202*b*. A wall 202*c* is preferably located along the axis of the inner diameter surface 202*a* of the armature member 202. The wall 202*c* preferably includes a central opening 202*d* that receives the stem member 200. The stem member 200 and armature member 202 are preferably guided by bushing members 206 and 214, respectively. An area defining a radial gap RG preferably exists between: the outer diameter surface 202*b* of the armature member 202 and the inner diameter surface 208*a* of flux tube 208; and inner diameter surface 216*a* of pole piece member 216. The stem member 200 preferably extends outwardly from the solenoid subassembly 102, e.g., at one end, to control the cam/valve timing mechanism (not shown).

In accordance with one embodiment of the present invention, an end of the armature member 202 that engages the flux tube member 208 preferably includes a uniform wall 202*e* formed by the inner diameter surface 202*a* and the outer diameter surface 202*b*. In accordance with a preferred embodiment of the present invention, the opposite end of the armature member 202 preferably includes at least one taper, and still more preferably more than one taper formed thereon. By way of a non-limiting example, taper 202*f* is preferably formed on the inner diameter surface 202*a*, and taper 202*g* is preferably formed on the outer diameter surface 202*b*. Taper 202*g* preferably comprises two angled taper portions, 202*h* and 202*i*, respectively. It should be appreciated that multiple tapers may be formed on either the inner and/or outer surfaces of the armature member 202.

In accordance with another embodiment of the present invention, pole piece member 216 also preferably includes tapers formed thereon. By way of a non-limiting example, taper 216*c* is formed on an outer diameter surface 216*b*, and taper 216*d* is formed on an inner diameter surface 216*a* of pole piece member 216. Taper 216*d* preferably includes two angled taper portions, 216*e* and 216*f*, respectively. It should be appreciated that multiple tapers may be formed on either the inner and/or outer surfaces of the pole piece member 216.

Without being bound to a particular theory of the operation of the present invention, these tapers will preferably control the magnetic flux linkage between the armature member 202 and the pole piece member 216 as the armature member 202 moves through its stroke. This control of flux linkage will preferably determine the force vs. stroke vs. current relationships. Without being bound to a particular theory of the operation of the present invention, the combination of the low cross-sectional thickness of the tapered portions of the armature member 202 and the pole piece member 216, along with the angle section, result in a high axial force/stroke ratio for a given diameter of the armature member and/or the pole piece member, and a force highly independent of stroke.

The angled surfaces of the present invention can preferably be adjusted to provide both linear and non-linear force vs. stroke relationships and force vs. current relationships. Thus, it will be appreciated that the angles of the tapers can be modified to suit the particular performance requirements of the solenoid operation. In accordance with a preferred embodiment of the present invention, the taper angles are in the range of about 4 to about 10 degrees. In accordance with a more preferred embodiment of the present invention, the taper angles are in the range of about 5 to about 7 degrees. In the situation wherein at least two tapers are provided on a surface of any of the components of the present invention, such as but not limited to the armature member and/or the pole piece member, the angles of the tapers are preferably not substantially equal. That is, the angle formed by the first tapered surface is preferably less than or greater than the angle formed by the second tapered surface.

In accordance with another embodiment of the present invention, a central portion 208*b* of the flux tube member 208 preferably includes a bore 208*c* that preferably receives bushing member 206. A portion of the central portion 208*b* preferably engages the inner diameter 202*a* of the armature member 202 as the armature member 202 moves through its stroke. An area defining a radial air gap RAG will preferably exist over the axial engagement. This engagement will preferably allow magnetic flux to link between the flux tube member 208 and the armature member 202 to improve the resulting force of the solenoid 100. The armature member 202 and the flux tube member 208 also preferably include areas defining axial air gaps AAG1 and AAG2, respectively, which can aid flux linkage and improve resulting force.

It should be noted that guide bushings are preferably located along the central axis CA and inside of the armature member 202. This additional space is generally required because the stem member 200 must extend along the central axis CA to engage with the bushing member, e.g., 214, and maintain engagement through its stroke. Furthermore, locating bushing member 214 along the central axis CA, within the armature member 202, will preferably reduce the overall length of the solenoid 100.

In accordance with one aspect of the present invention, the solenoid 100 of the present invention is intended to cooperate with a cam/valve timing mechanism that may provide the bias force to the armature member 202 that will cause it to move in a direction towards the flux tube member 208. However, an optional biasable member 234 (e.g., a spring) can be installed within the solenoid 100 if the external bias force is not available.

Figure 6:
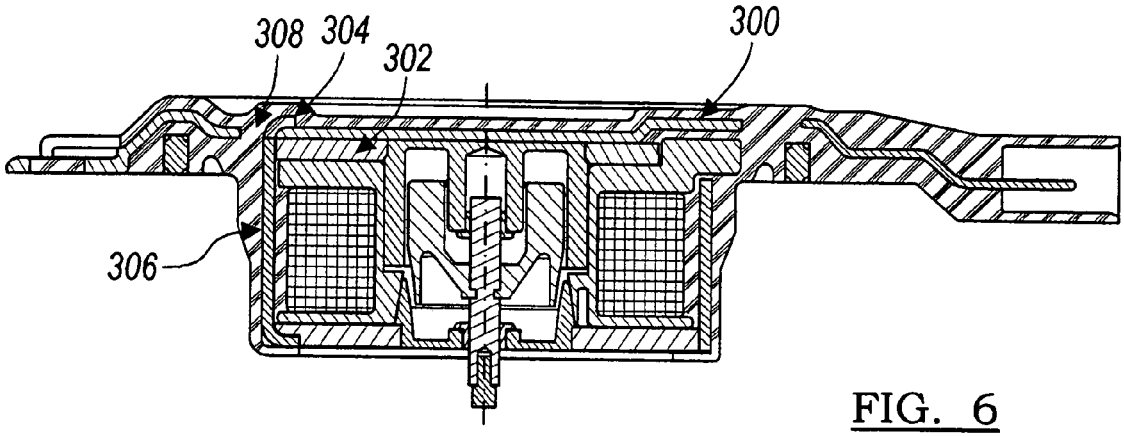
FIG. 6 illustrates a sectional view of an alternative solenoid assembly, in accordance with an alternative embodiment of the present invention.

Referring specifically to FIG. 6, it should also be noted that a bracket member 300 could be a separate component or an integral part of one of the solenoid components (e.g., the flux tube, pole piece washer, and the like), in accordance with an alternative embodiment of the present invention. In this view, the bracket member 300 is preferably attached to the flux washer member 302. A retaining tab member 304 is preferably formed into a sleeve member 306 and passes through a slot 308 in bracket member 300. By way of a non-limiting example, during the assembly process the retaining tab member 304 is preferably formed against the bracket member 300, retaining both the bracket member 300 and the flux washer member 302. The bracket member 300 can preferably be made of suitable magnetic material and act as one of the magnetic elements of the solenoid 100.

Without being bound to a particular theory of the operation of the present invention, the solenoid 100 of the present invention preferably operates in the following general manner. When the electric control signal is applied to the coil assembly 220 it will develop a magnetic field within the solenoid 100. The magnetic elements, i.e., the armature member 202, flux tube assembly 204, casing 232, and the pole piece assembly 212, will provide a path for the magnetic flux. The magnetic flux is preferably linked between the armature member 202, flux tube assembly 204, and pole piece assembly 212 via air gaps AG, RG, MG1, and AAG2. The magnetic field and the resulting force will preferably cause the armature member 202 to move towards the pole piece member 216. The rate and linearity of movement are preferably determined by geometric relationships between the armature member 202 and the pole piece member 216 and the characteristic of the load force, typically, but not limited to a bias spring.

As the level of the control signal changes, the stem member 200 will preferably move outwardly or inwardly to control the position of the associated mechanism, e.g., the cam/valve timing mechanism. Progressively increasing the level of the control signal will preferably increase resulting force and the outward movement of the stem member 200. Reducing the level of the control signal will preferably reduce the resulting force and the stem member 200 will move inwardly with the bias force of the cam/valve timing mechanism or optional internal bias spring 234.

Figure 7:
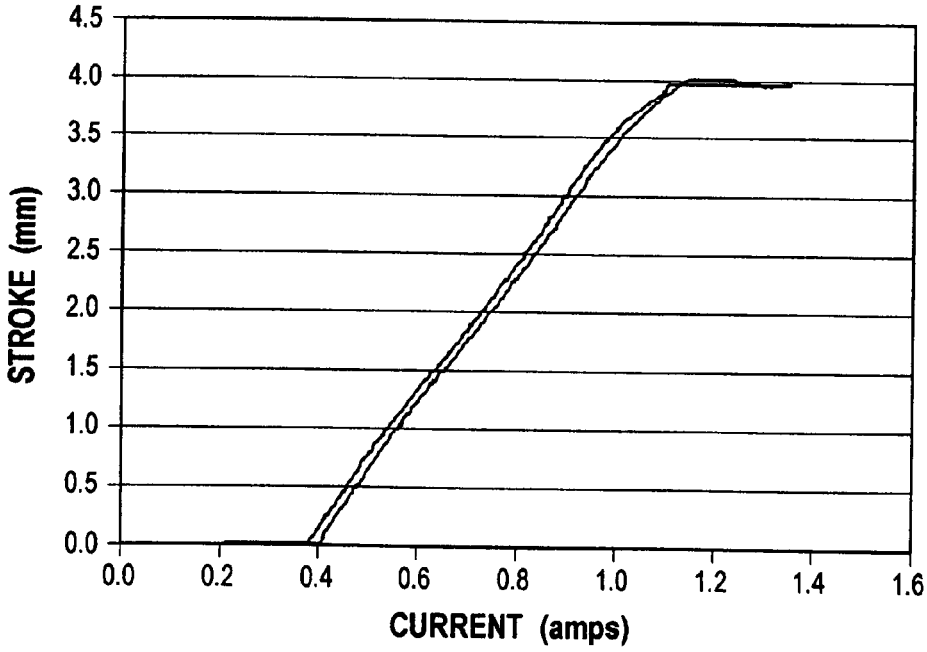
FIG. 7 illustrates a graphical view of the stroke vs. current performance characteristics of a solenoid configured in accordance with the general teachings of the present invention.

FIG. 7 illustrates a typical current vs. stroke (i.e., travel) performance profile for the solenoid 100 of the present invention, in accordance with the general teachings of the present invention.

With respect to the specific design and performance specifications of the solenoid of the present invention, the following illustrative specifications were established: (1) total travel available=6 mm; (2) spool valve travel=4 mm; (3) load=1.8 N at 0 mm; 9 N at 4 mm; (4) 0-1 A, 10 N force at 1 A 10V, 125° C.; operation to 150° C. with some degradation; (5) 3% maximum hysteresis at the null position; and (6) packaging of 30 mm height, 60 mm diameter. It should be appreciated that these specifications, which are illustrative in nature, can be reasonably modified without departing from the scope of the present invention.

Figure 8:
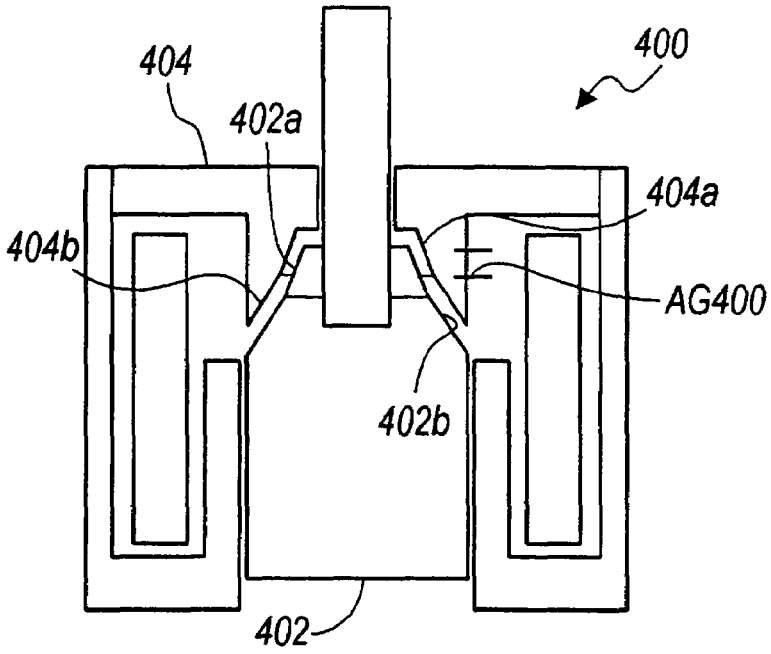
FIG. 8 illustrates a schematic view of an alternative solenoid subassembly, in accordance with a second alternative embodiment of the present invention.

A first alternative solenoid subassembly 400 is shown in FIG. 8, in accordance with a second alternative embodiment of the present invention. As with the previously described embodiment, the basic principle is to taper the faces of the armature member 402 and/or pole piece member 404. In this view, the armature member 402 has at least two tapered surfaces 402*a*, 402*b*, respectively, formed on a surface thereof, and the pole piece member 404 also has at least two tapered surfaces 404*a*, 404*b*, respectively, formed on a surface thereof. Without being bound to a particular theory of the operation of the present invention, it is believed that this configuration has the effect of bringing about the magnetic interaction of the armature/pole piece in a substantially gradual manner. The result is that the force can now be made more constant across the stroke range. In effect, the force gain as the air gap AG400 becomes small is traded for increased force when the air gap AG400 is large.

Figure 9:
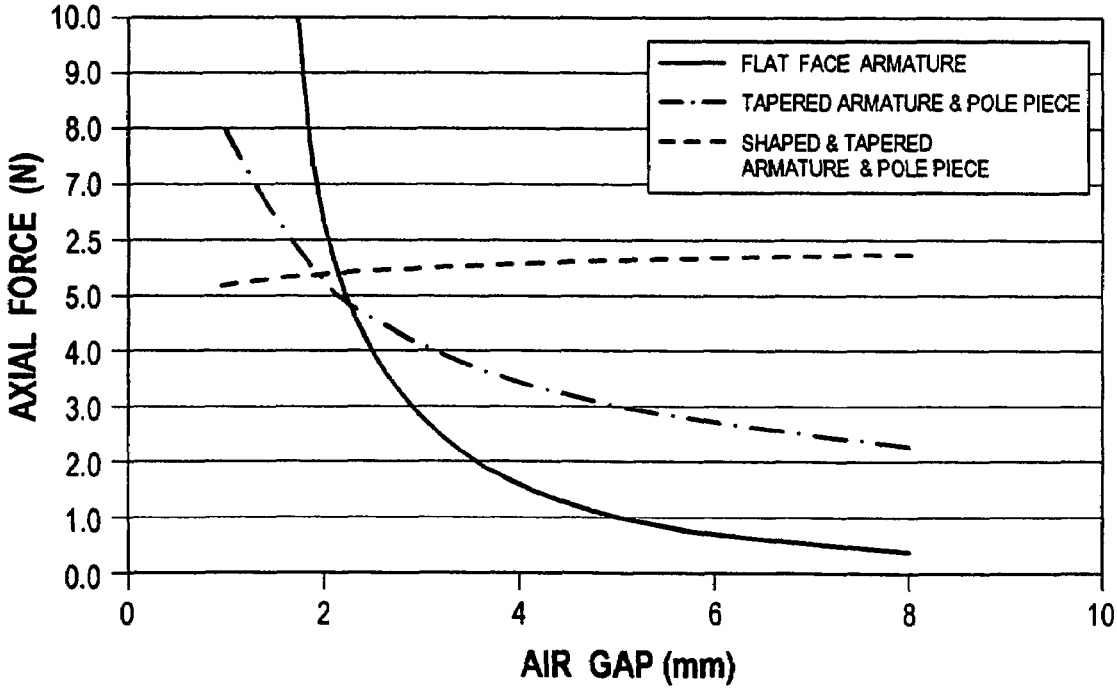
FIG. 9 illustrates a graphical view of the axial force vs. air gap performance characteristics of a solenoid configured in accordance with the general teachings of the present invention, as compared to a conventional solenoid.

Additionally, the force gain with current becomes substantially more linear because of increased magnetic saturation present in the circuit throughout the range of current levels. With reference to FIG. 9, there is shown a comparative profile of the axial force and air gap performance characteristics of a conventional solenoid with a flat-faced armature and solenoids with a tapered armature and a tapered armature/pole piece, in accordance with the present invention. As illustrated in FIG. 9, the force gain with current is substantially more linear in the solenoid with the tapered armature/pole piece.

Because the variable force solenoids of the present invention position the spool valve open loop, hysteresis must be minimized for good system performance. There are two main causes of hysteresis, namely, side forces and material selection.

With respect to side forces, the magnetic attraction of the armature to the rest of the circuit creates not only the useful axial force but also radial forces. These radial forces become quite significant with tapered armatures at the end of the stroke. If symmetry around the armature axis is maintained, the radial forces cancel out. However, symmetry is disrupted by such factors as irregular features, runout, bearing clearance, and the like. The effects of each of these are difficult to quantify, but their effect on the system is quite noticeable as bearing friction. Suggested design solutions include, without limitation: (1) making parts as symmetrical, as possible, especially in the armature area; (2) locating the bearings for minimal true position stackup; (3) selecting low-friction bearings and appropriate stem surface finish; (4) applying a dither current to keep moving mass in motion to minimize static friction effects; and (5) reducing moving mass to facilitate dithering.

Figure 10:
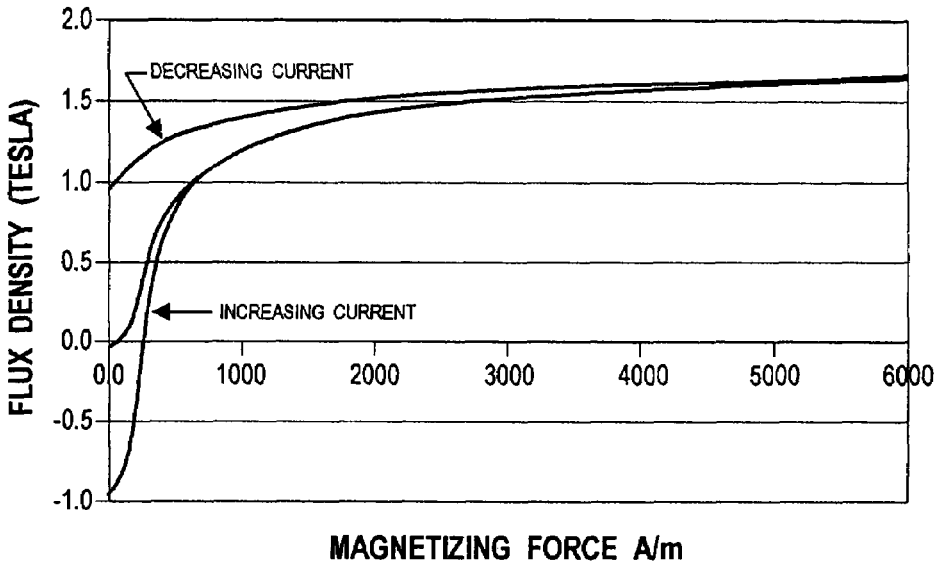
FIG. 10 illustrates a graphical view of the flux density vs. magnetizing force performance characteristics of a piece of 1215 steel, in accordance with the general teachings of the present invention.

With respect to material selection, the magnetization of a piece of steel is not a fully reversible process. For example a B-H curve for a 1215 steel sample, as shown in FIG. 10, illustrates that when the magnetizing force (current) is applied, the resulting flux (and consequently the developed force) will be different depending on whether the current is increasing or decreasing. Solutions to this problem include, without limitation: (1) annealing the iron parts; (2) using materials that have good magnetic properties; and (3) using control strategies in which the command signal is always in one direction. By way of a non-limiting example, if the solenoid is operated at 0.7 amps and the command is to go to 0.5 amps, the current would be reduced to 0.4 amps then go back up to 0.5 amps.

Figure 11:
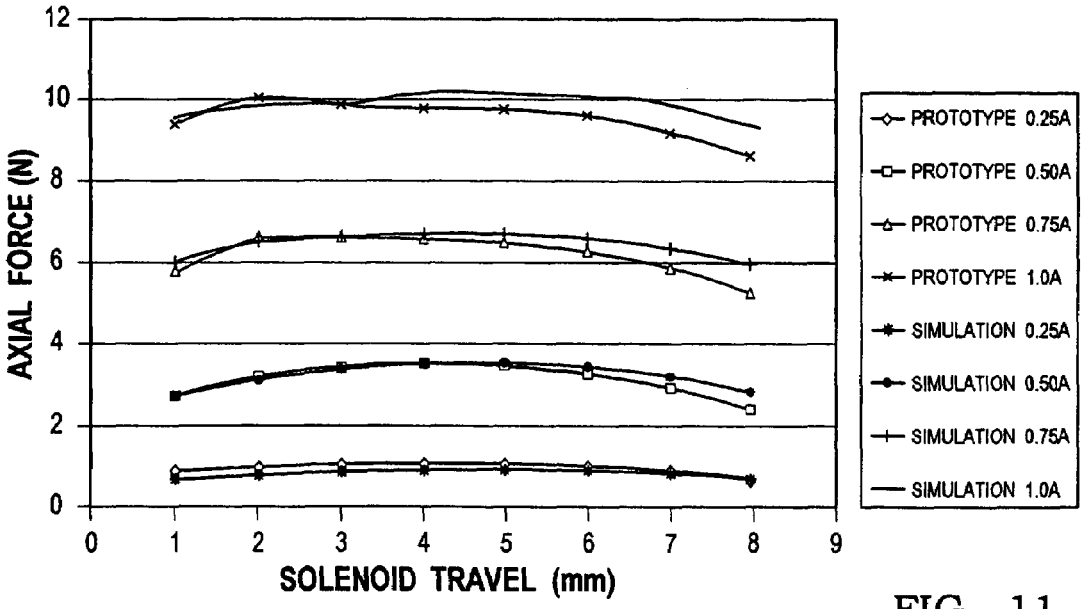
FIG. 11 illustrates a graphical view of the axial force vs. solenoid travel performance characteristics of various solenoids configured in accordance with the general teachings of the present invention.

Although magnetic circuit analysis is reasonably accurate for simple geometry, it falls short due to the magnetic characteristic of the iron becoming non-linear as saturation is approached. Fortunately, simulation software is readily available. The software used to evaluate the solenoid performance characteristics of the present invention was a 2D axisymmetric type sold under the trade name MAGNETO, which is readily commercially available from Integrated Engineering Software Sales, Inc. (Winnipeg, Canada). This software program uses the boundary element method to calculate a solution. With this software, the geometry of the solenoid is constructed as half a section and rules of symmetry about the armature axis are applied. This software program has the following advantages: (1) geometry is constructed and modified very easily; (2) parametric solving is easily accomplished; (3) correlation to actual results is good (see FIG. 11); (4) although side forces cancel out in the model, the ratio of axial force to the incremental side force can be plotted and analyzed.

Figure 12:
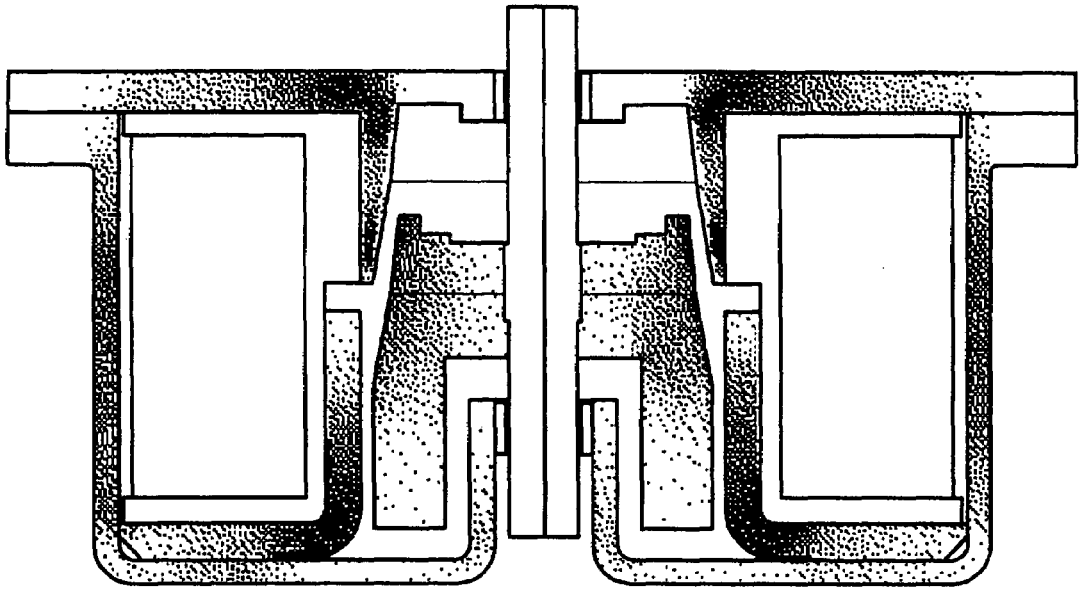
FIG. 12 illustrates a schematic view of a solenoid configured in accordance with the general teachings of the present invention wherein the flux density characteristics during typical operation are shown.

Referring to FIG. 12, a typical plot of the flux density of the solenoids of the present invention is shown, wherein the regions of relatively high flux areas (indicated by heavy stippling) are focused at the air gap between the armature and the pole piece, with relatively lower densities elsewhere (indicated by light stippling).

Figure 13:
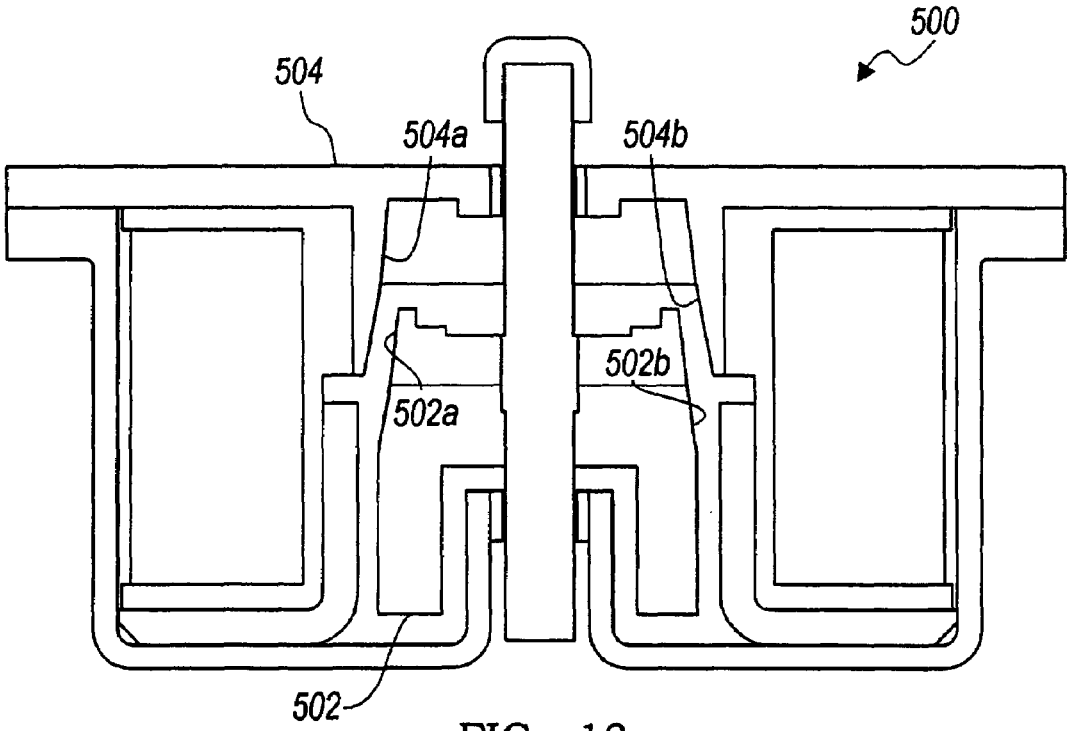
FIG. 13 illustrates a schematic view of a second alternative solenoid subassembly, in accordance with a third alternative embodiment of the present invention.

A second alternative solenoid subassembly 500 is shown in FIG. 13, in accordance with a third alternative embodiment of the present invention. As with the previously described embodiments, the armature member 502 has at least two tapered surfaces 502*a*, 502*b*, respectively, formed on a surface thereof, and the pole piece member 504 also has at least two tapered surfaces 504*a*, 504*b*, respectively, formed on a surface thereof. However, this design differs in that it encompasses the elements of a production design but utilizes machined components and fasteners to facilitate assembly/disassembly, and to eliminate tooling costs.

The performance of the embodiment was satisfactory for initial development work, although several areas of improvement were identified, including: (1) total stroke—a stackup study showed that the solenoid stroke should be increased from 6 mm to 8 mm; (2) force—the force curves had excessive droop at both ends of the total stroke; (3) dither frequency—dithering essentially stopped at 100 Hz and above. Measurement of the moving mass was 36 grams vs. 27 grams for the Phase 1 (SEGR) solenoid. A target of effective dithering at 100 Hz minimum with 0.100 Amp peak-to-peak dither current was established; and (4) hysteresis was in the 0.2-0.3 mm (5%-7.5%) range, which is acceptable for most development applications (but may not meet all OEM requirements, such as those in 3% range).

Figure 14:
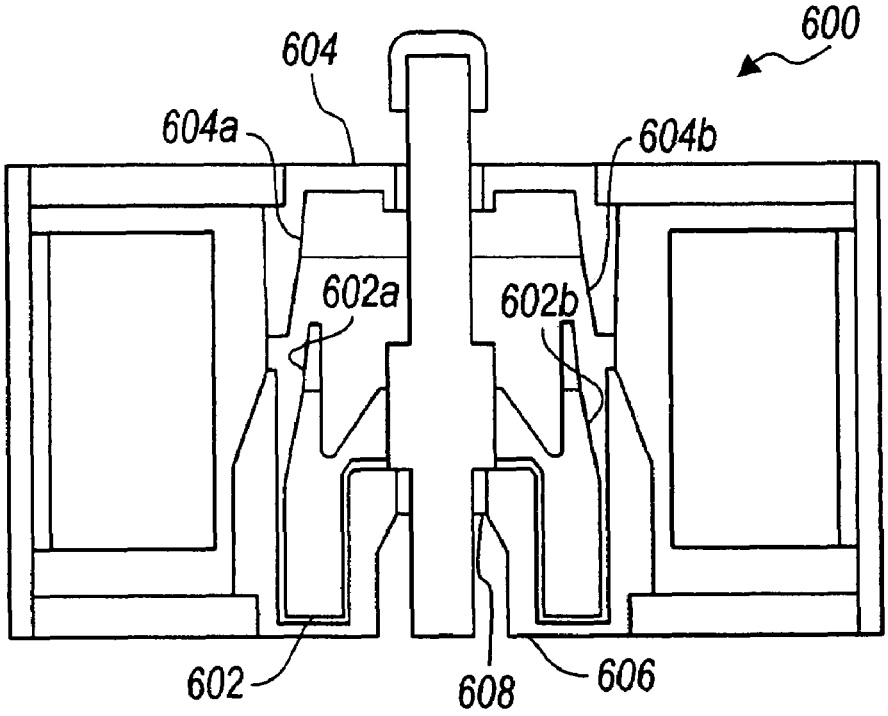
FIG. 14 illustrates a schematic view of a third alternative solenoid subassembly, in accordance with a fourth alternative embodiment of the present invention.

A third alternative solenoid subassembly 600 is shown in FIG. 14, in accordance with a fourth alternative embodiment of the present invention. In this view, the armature member 602 has at least two tapered surfaces 602*a*, 602*b*, respectively, formed on a surface thereof, and the pole piece member 604 also has at least two tapered surfaces 604*a*, 604*b*, respectively, formed on a surface thereof. Additionally, the armature member 602 includes areas of decreased mass or depressions formed on various surfaces thereof. Furthermore, the respective tapered surfaces can be provided with a continuously variable angle, as shown. This design primarily addressed those issues discussed above. In this embodiment, total stroke was increased to 8.5 mm.

A significant feature that enabled the stroke increase was the design of the flux tube member 606. The flux tube member 606 is provided with areas defining open ends or depressions formed therein for at least partially receiving portions of the armature member 602. This permits the establishment of at least one, more preferably at least two, still more preferably at least three, and most preferably at least four confronting surfaces to be formed therebetween. Preferably, these confronting surfaces can be either radially and/or axially opposed from one another. Without being bound to a particular theory of the operation of the present invention, these confronting surfaces are thought to be useful for at least aiding in the formation of a magnetic flux circuit (e.g., when the solenoid (e.g., the coil) is energized), especially with respect to any internal radial and/or axial confronting surfaces of the armature member 602 and flux tube member 606.

Without being bound to a particular theory of the operation of the present invention, the intended purpose of the configuration of the flux tube member 606 is to complete the magnetic circuit by coupling the flux to the armature member 602. The flatness of the force curves at the end of the stroke is highly dependent on this coupling, and this requires some minimum overlap of the armature member 602 outer diameter and the flux tube member 606 inner diameter. Although this need directly conflicts with the low solenoid profile requirement, the problem was resolved by redesigning the flux tube member 606 to a screw machine part with the stem bearing 608 pressed directly to it. This permits coupling of the armature member 602 on both the inner and outer diameters and the direct bearing mounting reduces side forces by improved concentricity. Additionally, the armature member 602 was redesigned to remove excess mass. By way of a non-limiting example, the total moving mass was reduced to 25 grams.

Functional testing of the variable force solenoids of the present invention requires measurement of both force and position. For solenoid force testing, a traditional method uses a piezoelectric transducer and a moveable sled to measure force as a function of stroke. Because the operator adjusts the stroke, it does not replicate the conditions under which the variable force solenoid operates. Additionally, the armature contacts the stationary transducer and the benefits of dither are greatly diminished. However, for force measurement, it works very well.

In order to correct the limitations of the force sled, fixturing was changed to allow the variable force solenoid of the present invention to stroke against a spring with stops, to simulate the spool valve load and travel. A Linear Variable Differential Transformer was attached to the opposite end of a variable force solenoid in accordance with the present invention to allow measurement of stroke vs. current. This was an improvement; however, in practice the mass of the transducer core added significantly to total mass, and the uncertainty of verifying the concentricity of the core to prevent rubbing against the transducer coil was always present.

A subsequent test method incorporated a laser to provide a non-contact means to measure position. A Visual Basic data acquisition custom configured program provides a user-friendly means to test variable force solenoids with selectable gate points for position and hysteresis.

In order to evaluate other designs of variable force solenoids, several requirements were established, namely: (1) low part count; (2) simplicity of components; (3) inherent alignment of critical components; (4) match process to part requirements; and (5) maintain packaging constraints. Several alternative design concepts were created and evaluated for various attributes based, in part, on these requirements.

Figure 15:
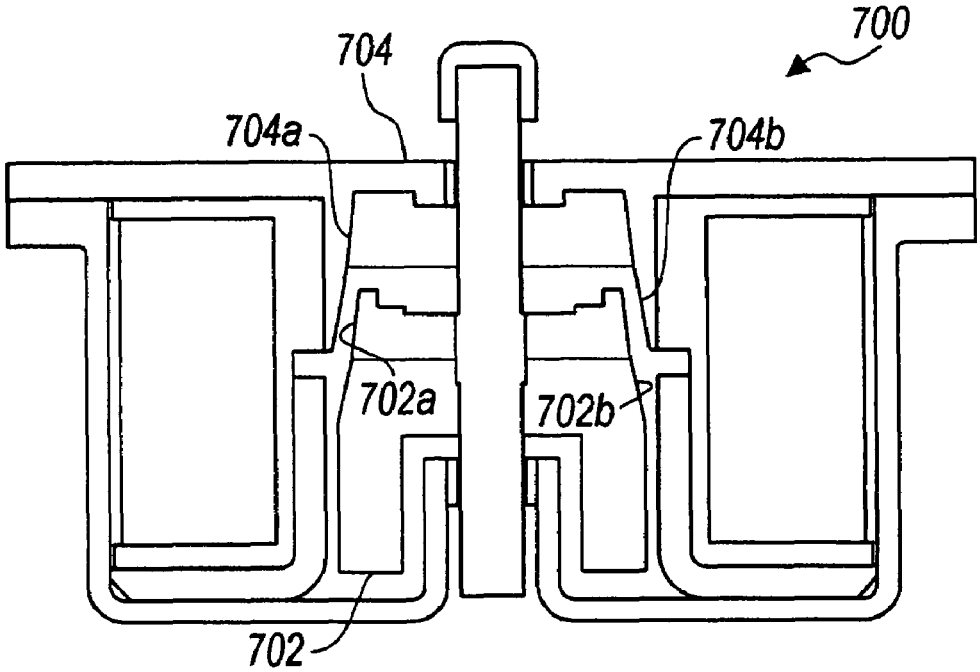
FIG. 15 illustrates a schematic view of a fourth alternative solenoid subassembly, in accordance with a fifth alternative embodiment of the present invention.

A fourth alternative solenoid subassembly 700 is shown in FIG. 15, in accordance with a fifth alternative embodiment of the present invention. As with the previous embodiments, the armature member 702 has at least two tapered surfaces 702*a*, 702*b*, respectively, formed on a surface thereof, and the pole piece member 704 also has at least two tapered surfaces 704*a*, 704*b*, respectively, formed on a surface thereof. However, this embodiment differs in that it utilized deep draw stampings.

Figure 16:
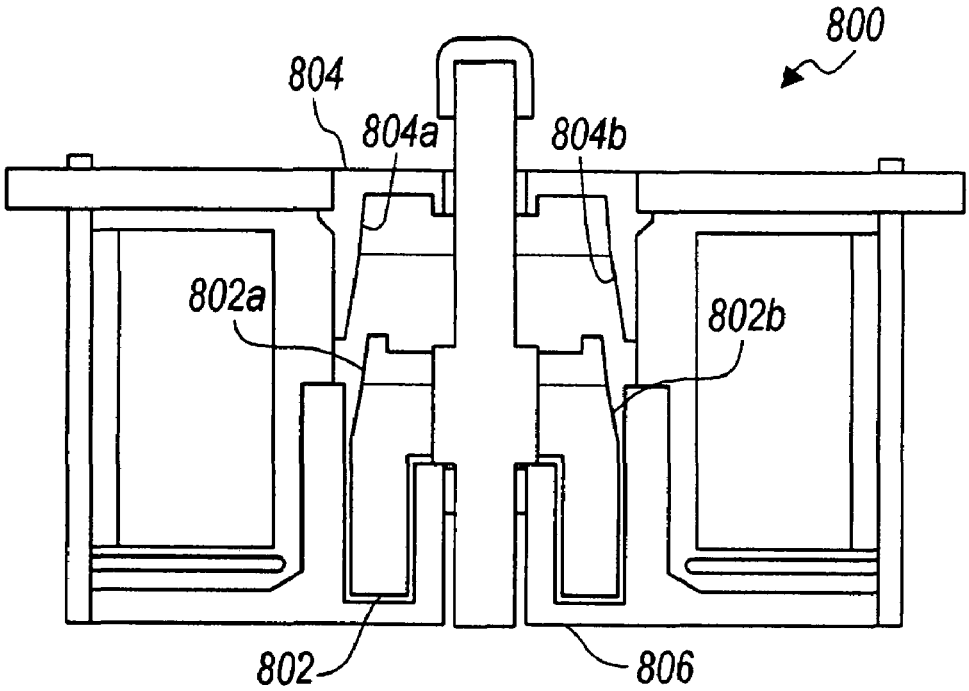
FIG. 16 illustrates a schematic view of a fifth alternative solenoid subassembly, in accordance with a sixth alternative embodiment of the present invention.

A fifth alternative solenoid subassembly 800 is shown in FIG. 16, in accordance with a sixth alternative embodiment of the present invention. As with the previous embodiments, the armature member 802 has at least two tapered surfaces 802*a*, 802*b*, respectively, formed on a surface thereof, and the pole piece member 804 also has at least two tapered surfaces 804*a*, 804*b*, respectively, formed on a surface thereof. However, this embodiment differs in that it features a powdered metal pole piece member 804 and flux tube member 806 to maintain a low overall height.

Figure 17:
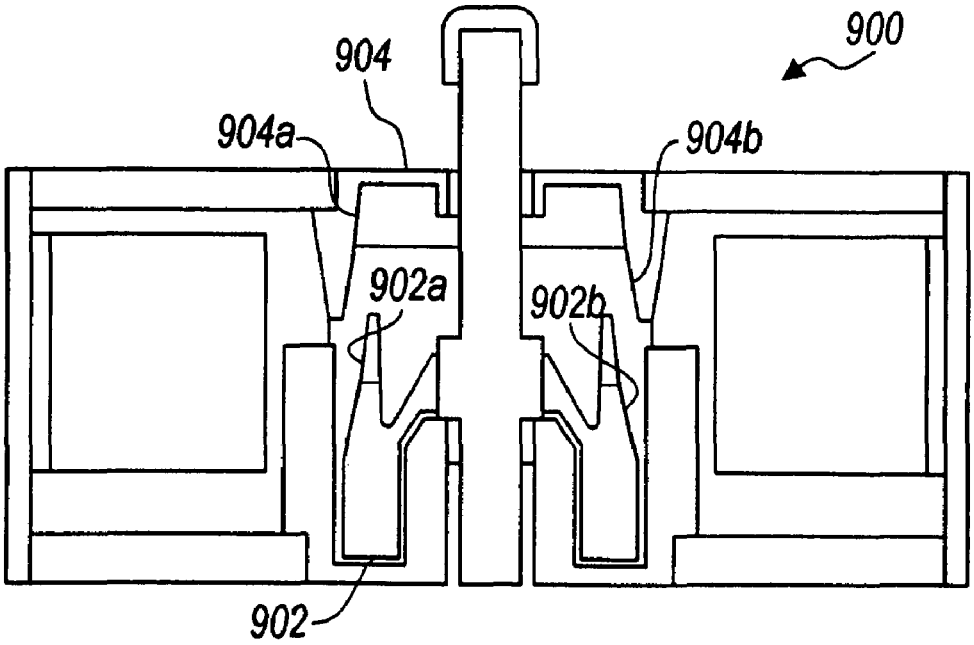
FIG. 17 illustrates a schematic view of a sixth alternative solenoid subassembly, in accordance with a seventh alternative embodiment of the present invention.

A sixth alternative solenoid subassembly 900 is shown in FIG. 17, in accordance with a seventh alternative embodiment of the present invention. As with the previous embodiments, the armature member 902 has at least two tapered surfaces 902*a*, 902*b*, respectively, formed on a surface thereof, and the pole piece member 904 also has at least two tapered surfaces 904*a*, 904*b*, respectively, formed on a surface thereof. Furthermore, the respective tapered surfaces can be provided with a continuously variable angle, as shown. With packaging constraints driving towards a lower profile of the variable cam timing system, this embodiment was proposed as a solution. The main attribute of this design is a height reduction from 31 mm to 28 mm. This was obtained mainly by proportioning of components and verified by many trials of magnetic simulation.

Figure 18:
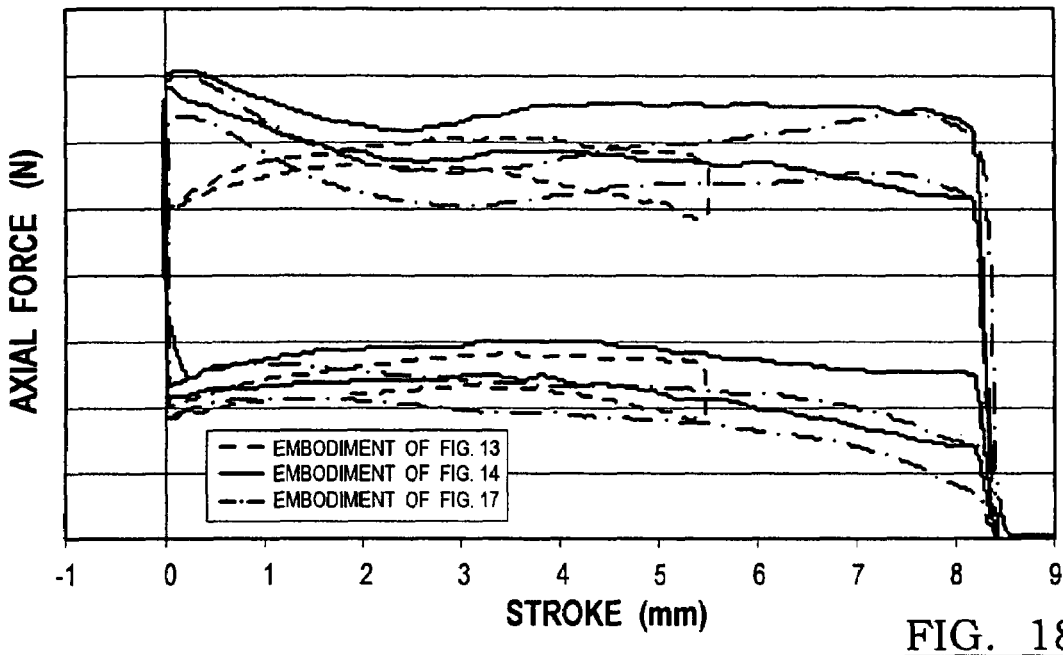
FIG. 18 illustrates a graphical view of the axial force vs. stroke performance characteristics of various solenoids configured in accordance with the general teachings of the present invention.

A force vs. stroke summary of some of the previously described solenoids of the present invention is shown in FIG. 18, in accordance with the general teachings of the present invention. As is clearly shown, the force curve profiles depicted therein are substantially flat in accordance with the intended performance characteristics of the solenoids of the present invention.

Figure 19:
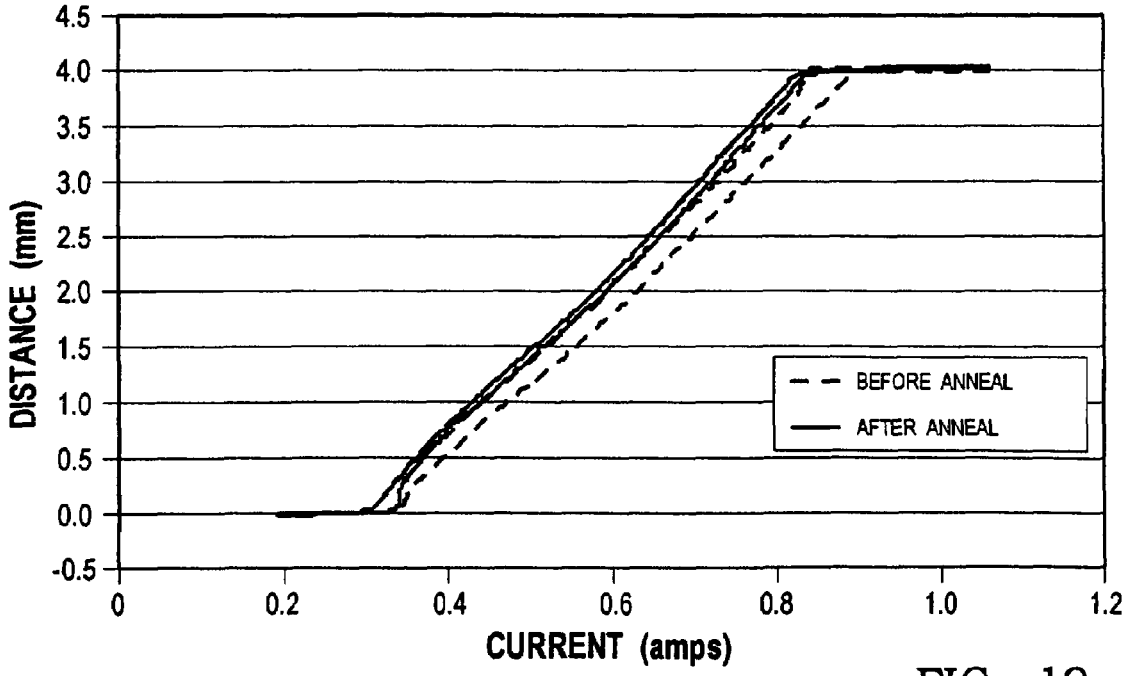
FIG. 19 illustrates a graphical view of the distance vs. current performance characteristics of a solenoid configured in accordance with the general teachings of the present invention, both before and after annealing.

While the embodiment depicted in FIG. 17 met packaging requirements, hardware testing showed no real improvements in hysteresis. With renewed emphasis on hysteresis reduction, it was decided to determine the potential benefits of proper annealing of the magnetic circuit. Toward this end, the iron parts were annealed in a 75% hydrogen, 25% nitrogen atmosphere at 1550-1600° F. for four hours. This process was selected to yield the best magnetic properties. The hysteresis reduction due to the annealing was approximately 50% (see FIG. 19). It should be noted that similar benefits may be obtained with a less costly heat treatment of selected parts.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A solenoid, comprising:

a first magnetic member moveable along an axis and having an outer diameter;

a second magnetic member having an inner diameter, wherein the first magnetic member is operable to be at least partially co-axially disposed within the second magnetic member;

a third magnetic member wherein the third magnetic member is selectively operable to engage with and be at least partially disposed within the first magnetic member, wherein said first, second, and third magnetic members define a single path for magnetic flux and said third magnetic member and said second magnetic member are axially spaced apart such that said single path of magnetic flux flows parallel to said axis between at least said second magnetic member and said third magnetic member; and a coil member, wherein the coil member is co-axially disposed about the outer diameter of the first magnetic member, wherein the first magnetic member is selectively operable to urge toward the second magnetic member when the coil member is energized.

2. The solenoid of claim 1, wherein the first magnetic member, said second magnetic member and said third magnetic member are each one selected from the group comprising an armature member, a flux tube member, a pole piece member, and combinations thereof.

3. The solenoid of claim 1 further comprising a stem member extending from said first magnetic member, wherein said stem member is operable to move into said third magnetic member.

4. The solenoid of claim 1 wherein the first magnetic member further comprises an inner diameter, wherein the inner diameter includes at least one tapered surface formed thereon.

5. The solenoid of claim 1 wherein the inner diameter of the second magnetic member further comprises at least one tapered surface formed thereon.

6. The solenoid of claim 1 further comprising a biasable member disposed between said first and second magnetic members.

7. The solenoid of claim 1 further comprising a stem member extending from the first magnetic member, wherein the stem member is operable to extend into an area defining an aperture formed in the second magnetic member.

8. The solenoid of claim 1 wherein the first magnetic member and the third magnetic member include at least one area defining a depression formed on a surface thereof.

9. The solenoid of claim 8 wherein the first magnetic member and the third magnetic member include at least one confronting surface formed therebetween.

10. The solenoid of claim 9 wherein the first magnetic member is coupled to a magnetic flux circuit when the solenoid is energized.

11. A solenoid comprising:

a flux tube having a central portion;

an armature having an inner diameter, wherein said armature is operable to move along an axis and with respect to said flux tube and part of said central portion moves within said inner diameter of said armature;

a stem member extending from said armature, wherein said stem member is operable to extend into said central portion of said flux tube and move within said central portion during the movement of said armature with respect to said flux tube;

a pole piece operably positioned with respect to said armature;

a bobbin with a coil wound upon said bobbin, wherein said coil, said armature, said flux tube, and said pole piece provide and control a magnetic flux when said coil is energized causing said armature to move within said solenoid, wherein said flux tube, armature and pole piece define a single path for magnetic flux and said flux tube and said pole piece are axially spaced apart such that said single path of magnetic flux flows substantially parallel to said axis between at least said flux tube and said pole piece; and wherein said armature moves toward said pole piece when said coil is energized and the distance that the armature travels toward said pole piece is substantially proportional to the current applied to said coil.

12. The solenoid of claim 11 further comprising a radial air gap between said central portion and said inner diameter.

13. The solenoid of claim 11 further comprising:

an inner diameter of said flux tube member; and an outer diameter of said armature wherein said inner diameter of the flux tube member and said outer diameter of the armature form at least one confronting surface formed therebetween.

14. The solenoid of claim 11 wherein the armature is coupled to a magnetic flux circuit when the solenoid is energized.

15. The solenoid of claim 11 further comprising a stem member extending from said armature, wherein said stem member is operable to move into said central portion of said flux tube.

* * * * *

UNITED STATES PATENT AND TRADEMARK OFFICE

CERTIFICATE OF CORRECTION

PATENT NO. : 7,564,332 B2
APPLICATION NO. : 11/712345
DATED : July 21, 2009
INVENTOR(S) : Robert J. Telep It is certified that error appears in the above-identified patent and that said Letters Patent is hereby corrected as shown below:

Column 7,
Line 50, "MG1" should be -- AAG1 --.

Signed and Sealed this

Fifteenth Day of September, 2009

David J. Kappos

David J. Kappos
*Director of the United States Patent and Trademark Office*